US012214401B2

(12) United States Patent
Siegrist et al.

(10) Patent No.: US 12,214,401 B2
(45) Date of Patent: Feb. 4, 2025

(54) SEAMING ROLLER FOR A CLOSING APPARATUS

(71) Applicant: Ferrum Packaging AG, Schafisheim (CH)

(72) Inventors: Marco Siegrist, Rottenschwil (CH); Lukas Meier, Niederwil (CH); Alexander Frieden, Auenstein (CH)

(73) Assignee: FERRUM PACKAGING AG, Schafisheim (CH)

( * ) Notice: Subject to any disclaimer, the term of this patent is extended or adjusted under 35 U.S.C. 154(b) by 517 days.

(21) Appl. No.: 17/614,692

(22) PCT Filed: Jun. 13, 2019

(86) PCT No.: PCT/EP2019/065604
§ 371 (c)(1),
(2) Date: Nov. 29, 2021

(87) PCT Pub. No.: WO2020/249220
PCT Pub. Date: Dec. 17, 2020

(65) Prior Publication Data

US 2022/0193749 A1 Jun. 23, 2022

(51) Int. Cl.
*B21D 37/04* (2006.01)
*B21D 51/32* (2006.01)

(52) U.S. Cl.
CPC ..... *B21D 37/04* (2013.01); *B21D 51/32* (2013.01)

(58) Field of Classification Search
CPC ..... B21D 51/32; B21D 37/04
See application file for complete search history.

(56) References Cited

U.S. PATENT DOCUMENTS 2,748,733 A 6/1956 Pechy
3,742,883 A * 7/1973 Costanzo ..... B21D 51/32 413/29

(Continued)

FOREIGN PATENT DOCUMENTS

CN 1171988 A 2/1998
CN 1669697 A 9/2005

(Continued)

OTHER PUBLICATIONS

International Search Report and Written Opinion issued Feb. 28, 2020 in corresponding International Patent Application No. PCT/EP2019/065604 filed Jun. 13, 2019 (with English Translation).

*Primary Examiner* — Jimmy T Nguyen
(74) *Attorney, Agent, or Firm* — Global IP Counselors, LLP

(57) ABSTRACT

A seaming roll for sealing a container includes a rotation body rotatable on a bolt for sealing the container. The rotation body includes a first basic side and a second basic side different from the first basic side and a bearing. The bolt is arranged on the bearing via the first basic side such that the rotation body can be rotated about the bolt in the circumferential direction of the second basic side when the container is sealed. The seaming roll further includes an exchangeable seaming profile for seaming a container lid with a body of the container and a fastening mechanism. The exchangeable seaming profile is detachably connected to the rotation body via the fastening mechanism.

18 Claims, 5 Drawing Sheets

(56) References Cited

U.S. PATENT DOCUMENTS

| | | | | |
|---|---|---|---|---|
| 5,299,899 | A | 4/1994 | Katou et al. | |
| 5,853,275 | A | 12/1998 | Lentz et al. | |
| 2012/0021882 | A1* | 1/2012 | Reiner | F16C 19/505<br>492/47 |
| 2016/0274005 | A1 | 9/2016 | Toya et al. | |
| 2019/0300213 | A1* | 10/2019 | Reiner | B65B 7/2857 |

FOREIGN PATENT DOCUMENTS

| | | | |
|---|---|---|---|
| CN | 207996440 | U | 10/2018 |
| CN | 109335141 | A | 2/2019 |
| DE | 749636 | C | 11/1944 |
| DE | 4234115 | A1 | 5/1993 |
| GB | 2098899 | A | 12/1982 |
| GB | 2267667 | A | 12/1993 |
| JP | 3-95138 | U | 9/1991 |
| JP | 2003137392 | A | 5/2003 |
| JP | 2005262270 | A | 9/2005 |
| KR | 20150065097 | A | 6/2015 |
| KR | 101731913 | B1 | 5/2017 |

* cited by examiner

SEAMING ROLLER FOR A CLOSING APPARATUS

CROSS-REFERENCE TO RELATED APPLICATIONS

This application is a U.S. National Stage application of International Application No. PCT/EP2019/065604, filed Jun. 13, 2019, the contents of which are hereby incorporated by reference.

BACKGROUND

Field of the Invention

The disclosure relates to a seaming roll for sealing a container by a container lid. The disclosure further relates to a sealer with a seaming roll.

Background Information

When filling beverage cans or food cans, the cans pass through a can sealer after being filled with the beverage or the food, wherein the filled can bodies enter via a feed path and the can lids enter via a further feed path. The can sealer usually has several similar stations arranged in a carousel shape, in each of which one can is sealed with a can lid. The can lids are guided onto the can bodies and held on the can body with a holding plate of a seaming head. This holding also serves to fix the cans against breaking out of the circular path through which the cans pass in the can sealer due to the centrifugal force. In the can seamer, the can bodies are seamed with the can lid at the edges using a seaming roll and thus sealed. Normally, the can with the can lid is additionally rotated around its own axis of symmetry by the seaming head.

In DE 749636 and DE 4234115 A1, a generic can sealer is described. The can sealer comprises a clamping device for receiving a can to be sealed. In the operating state, the can to be sealed is inserted into the clamping device and secured by it in the axial and radial direction. A can lid is also inserted in a centered way over the can opening of the can to be sealed. In the area of the can opening, the can has a circumferential can flange and the can lid has a circumferential can lid flange. For sealing the can opening by the can lid, the can sealer additionally comprises two seaming rolls which are each mounted rotatably about an axis and which press the can flange and the can lid flange together by means of a force acting substantially radially, wherein the pressing is achieved by a continuous rolling in the circumferential direction along the circumference of the can opening.

From GB 2098899 A, a further can sealer is known. The can sealer comprises a clamping device for receiving the can to be sealed and a seaming roll. In the operating state, the can to be sealed is inserted into the clamping device and secured by it in the axial and radial direction. A can lid is also inserted in a centered way over the can opening of the can to be sealed. In the area of the can opening of the can body, the can has a circumferential can flange and the can lid has a circumferential can lid flange. For sealing the can opening by the can lid, the can sealer comprises a seaming roll which is each mounted rotatably about an axis and which press the can flange and the can lid flange together, wherein the pressing is achieved by a continuous rolling in the circumferential direction along the circumference of the can opening.

For an explanation of this sealing module, in the following reference is made to FIG. 1, on the basis of which the state of the art described above is described in more detail. To distinguish the state of the art from the present invention, the reference signs referring to features of known examples of the seaming roll are marked with an inverted comma, whereas features of embodiments according to the invention are marked with reference signs without an inverted comma.

FIG. 1 shows a sectional view of a known can sealer 1000' with a can 200' to be sealed and a can lid 202'.

According to FIG. 1, the known sealing module 1000' comprises a clamping device comprising a can support 22' and a seaming head 20', and a seaming roll 10' with a seaming roll profile rotatably mounted about the bolt 11'. The can lid 202' is arranged in a centered way above the opening of the can body 201'. In the area of the can opening, the can body 201' has a circumferential can flange and the can lid 202' has a circumferential can lid flange.

During the sealing process, the seaming roll 1' is brought into contact with the can flange and the can lid flange via the seaming roll profile. Here, the can flange and the can lid flange are pressed together by means of a force acting substantially radially via the seaming roll 1'. The pressing is achieved by a continuous rolling of the seaming roll 1' in the circumferential direction along the circumference of the can opening. By seaming the can body 201' with the can lid 202', a double seam is preferably created.

The seaming roll 1' for seaming a can 200' disclosed in GB 2098899 A consists of the bolt 11' and a rotatable rotation body 10', which attaches to the can 200' with the seaming profile. The rotation body 10' is cylindrical and has a first, round basic side and a second, round basic side opposite the first round basic side. Inside the seaming roll there is a bearing for receiving the bolt 11', whereby the bolt 11' is supported in the bearing via the first basic side. Thus, the rotation body 10' can rotate around the bolt 11' when sealing the can 200' in the circumferential direction of the second basic side. Here, the seam profile is usually brought into contact with the can lid 202' and the can 200' is then rotated along its can axis X'.

SUMMARY

It has been determined that a substantial disadvantage of the seaming rolls known from the state of the art is that a change of the seaming rolls is both expensive and also very time-consuming.

Long-life seaming rolls are made of high-performance materials in order to be able to seal large quantities of cans in a short time and to ensure a reliable operation of the can sealer, in particular in continuous operation. Since the entire rotation body must be made of sophisticated materials, the seaming rolls are very expensive or cannot be manufactured at all due to the dimensions of many materials. If the seaming roll is worn out or if another combination of can and can lid is to be sealed, the seaming roll must be exchanged. For this purpose, the seaming roll must be exchanged with the bolt in order to install a new unused seaming roll or to change the seaming roll tool. However, it is not only the removal and installation of the seaming roll that has to be carried out, but the entire can sealer must to be readjusted after the seaming roll has been changed. This is not only time-consuming, but also always requires a skilled technician to adjust the machine correctly after the change.

The object of the invention is therefore to provide a seaming roll for a sealer which avoids the adverse effects known from the state of the art. In particular, a seaming roll and a sealer are to be provided, by which both costs for the seaming rolls and also standstill times due to a tool change can be significantly reduced.

This object is met by a seaming roll for sealing a container and a sealer comprising the seaming roll as described herein.

According to embodiments of the invention, a seaming roll for sealing a container comprising a rotation body rotatable on a bolt is proposed. The rotation body has a first basic side and a second basic side different from the first basic side as well as a bearing. The bolt is arranged on the bearing, in particular in the bearing, via the first basic side in such a way that the rotation body can be rotated about the bolt in the circumferential direction of the second basic side when the container is sealed.

In contrast to the state of the art, the seaming roll comprises an exchangeable seaming profile for seaming a container lid with a body of the container and a fastening mechanism. The exchangeable seaming profile is detachably connected to the rotation body via the fastening mechanism.

This results in the following advantages. On the one hand, the amount of high-performance materials that are used for the seaming roll is much smaller, since only the seaming profile has to be made of them. On the other hand, the seaming profile can be changed much more quickly due to wear or when a tool change is necessary. Since the seaming profile is detachably connected to the rotation body, it can be easily replaced when changing without further adjustment of the sealer. Consequently, when changing, it is not necessary to replace the entire seaming roll with the bolt, but only the seaming profile, which can be changed easily and quickly by removing it from the rotation body after loosening the fastening mechanism. This means that there is no need to adjust the bolt and bearing on the seaming roll and sealer.

The container preferably includes the container lid/container closure and the body, whereby the body is sealed with the container lid/container closure. The container can be a container and in particular the container can be a can with a can lid and with a can body. The sealer is then accordingly a can sealer.

For sealing the can/the container, the rotating body is brought into contact with a can lid flange/lid flange of the can lid/container lid with its seaming profile in the operating state. By rotating the can/container the seaming roll is then rotated in the circumferential direction of the can/the container and in the circumferential direction of the second basic side, whereby the can flange/flange is seamed with the can lid flange/lid flange.

Within the framework of the present application, the term "second basic side different from the first basic side" cannot be understood to mean only that the second basic side is a basic side separate from the first basic side. In practice, the second basic side can be opposite the first basic side (i.e. opposite sides of a three-dimensional body) and in particular can also be opposite in parallel.

Within the framework of the invention, the can can be understood to be a rotationally symmetrical container which is sealed by the can sealer and the associated seaming roll. In one embodiment, a can preferably comprises a metal, in particular aluminum.

Within the framework of embodiments of the invention, the fact that the exchangeable seaming profile is detachably connected to the rotation body via the fastening mechanism can be understood to mean that the seaming profile is fixed to the rotation body via the fastening mechanism for the operating state and seaming of the cans/the containers and can be removed from the rotation body during exchange by releasing the fastening mechanism.

In practice, the fastening mechanism can comprise a pin on the rotation body and a notch on the seaming profile. When fastening the seaming profile, the notch of the seaming profile can be guided on the pin of the rotation body in order to connect and fix the seaming profile with the notch on the pin of the rotation body in a torque-proof and force-locking manner. In particular, the pin and the corresponding notch can be designed as a bayonet lock so that the seaming profile is connected to the rotation body in a force-locking manner after the pin has been inserted into the notch, for example by rotation. For this purpose, the notch could be designed as a curve or an angle. Of course, the rotation body could also comprise a corresponding notch and the seaming profile a corresponding pin. Particularly preferred, the seaming profile is fastened to the rotation body from the second basic side.

In an embodiment of the invention, the rotation body can comprise a cover for sealing the bearing. Here, the cover is detachably arranged on the second basic side of the rotation body and closes the bearing, which is preferably arranged inside the rotation body. Thus, a leakage of lubricants from the bearing is prevented by the cover.

In a particularly preferred embodiment, the cover can comprise the pin of the fastening mechanism. Here, the cover is arranged rotatably on the second basic side of the rotation body. When attaching the seaming profile, the seaming profile is placed with the notch over the pin of the cover onto the rotation body in a first cover position. The cover is then rotated from the first cover position to a second cover position, whereby the pin is moved in or over the notch so that the seaming profile is connected to the rotation body in a torque-proof and force-locking manner. Here, a bayonet lock mechanism is preferred, too.

Within the framework of the invention, the cover can be designed in different ways. In principle, the cover is a plate, which is preferably designed as a plate with at least one corner. Here, a corner must not have an angle, but can here also be curved or oval-curved.

In particular, the cover may alternatively have a shape corresponding to the second basic side of the rotation body. In addition, the cover can be designed as a polygon, i.e. a polygon-shaped cover, in particular a polygon-shaped plate. Here, the cover can have a symmetrical or asymmetrical polygon shape. At least one corner of the polygon is then designed as a pin of the fastening mechanism, which is used to fix the seaming profile with the notch. As also described above, when attaching the seaming profile, the seaming profile is placed with the notch over the cover onto the rotation body in a first cover position. In particular, the seaming profile has a shape corresponding to the polygon-shaped cover so that the seaming profile can be guided over the cover as precisely as possible. Then, the cover is rotated from the first cover position to a second cover position, whereby the corner (or corners) of the polygon is moved as a pin over the notch, so that the seaming profile is connected to the rotation body in a torque-proof and force-locking manner. Of course, the cover could also have notches and the seaming profile could have the corresponding pins.

In principle, the cover can have any shape as a polygon as long as there is at least one corner, preferably two corners, which act as pins. Thus, the cover could also be designed as an ellipsoid. As mentioned above, the corner here must not have an angle, but can here also be curved or oval-curved.

This embodiment, in which the seaming profile is attached to the rotation body over the cover, has an additional advantage. The cover does not have to be removed from the rotation body and thus not from the bearing for mounting the seaming profile. Thus, the bearing remains sealed and as a consequence the leakage of lubricants from the bearing is prevented, which is of utmost relevance for the sealing of cans filled with food or beverages.

In order to explain the previous fastening mechanism in more detail, it is briefly explained below on the basis of a square. However, the fastening mechanism works in the same way for other polygons or plate-shaped covers with at least one pin. The cover is thus designed as a square plate and is attached to the second basic side of the rotation body. The seaming profile has a corresponding square shape. When attaching the seaming profile, the seaming profile is placed over the cover on the second basic side onto the rotation body. As a consequence, the notches and pins are on top of each other. By rotating the cover, the corners of the cover are rotated to the edges of the seaming profile, thus fixing the seaming profile.

In practice, the fastening mechanism can additionally comprise a thread arranged on the rotation body and a counter thread arranged on the cover, wherein the seaming profile, as described above, is fastened to the rotation body over the cover. Here, the seaming profile is fixed between the cover and the rotation body by a thread rotation when the thread is tightened.

In a further important embodiment, the seaming roll comprises a safety mechanism, wherein the safety mechanism is arranged between the rotation body and the cover so that the rotation of the cover is delimited, in particular delimited to the rotation from the first cover position to the second cover position. The safety mechanism can be designed as a safety pin, which is arranged in a recess in the thread of the cover. The recess has a recess expansion in the direction of rotation of the thread, i.e. in the circumferential direction of the second basic side, so that the rotation of the cover is delimited to the recess expansion. In doing so, the cover is prevented from becoming completely detached from the rotation body and thus from the bearing, in order to prevent leakage of lubricants and thus contamination of the beverages and food in the can. To remove the cover completely, consequently, the pin must first be removed from the device. As an alternative, the safety mechanism can also be equipped with a paint marking device, for example in the form of a paint capsule pen, so that the opening of the bearing can be traced. Particularly preferred, a seal can be additionally arranged between the cover and the rotation body, so that the leakage of lubricants can be avoided in any case.

In a particularly advantageous embodiment of the invention, the fastening mechanism can, alternatively to the measures described above, comprise a thread arranged on the rotation body and a counter thread arranged on the seaming profile, so that the seaming profile can be screwed onto the rotation body. Here, the thread of the rotation body is preferably arranged on the second basic side.

In practice, the first basic side and/or the second basic side of the rotation body can have a round shape. Here, the rotation body can also be designed as a cylindrical rotation body.

In a cylindrical rotation body, the seaming profile is preferably designed as a seaming profile ring. The bearing of the seaming roll can be a ball bearing or a cylindrical roller bearing as already known in the state of the art.

According to embodiments of the invention, a sealer comprising the seaming roll according to embodiments of the invention is further proposed for sealing the container comprising the rotation body rotatable on the bolt. The rotation body has a first basic side and a second basic side different from the first basic side as well as a bearing. The bolt is arranged on the bearing via the first basic side in such a way that the rotation body can be rotated about the bolt in the circumferential direction of the second basic side when the container is sealed. The seaming roll comprises an exchangeable seaming profile for seaming a container lid with a body of the container and a fastening mechanism. The exchangeable seaming profile is detachably connected to the rotation body via the fastening mechanism.

In principle, the sealer according to embodiments of the invention can be analogous to the can sealers already known from the state of the art but differs in the seaming roll. Here, the advantage is that the known can sealers/sealers with the old seaming rolls can be modified with the seaming rolls according to embodiments of the invention in order to avoid the disadvantages of the state of the art.

In practice, the can sealer as described in the state of the art comprises the clamping device with which the container is fixed in the axial and radial direction for sealing and with which the container can be rotated in the circumferential direction for seaming the can flange (body flange) and the lid flange.

In principle, the sealer can also comprise at least two seaming rolls according to embodiments of the invention, preferably with different seaming profiles, so that containers/cans can be sealed according to a double seam principle, in which the containers/cans are usually sealed in two steps. One seaming roll is responsible for each step. The first seaming roll makes a preliminary seam, while the second seaming roll completely seals the can/container.

BRIEF DESCRIPTION OF DRAWINGS

The invention will be explained in more detail hereinafter with reference to the drawings.

DETAILED DESCRIPTION

Figure 1:
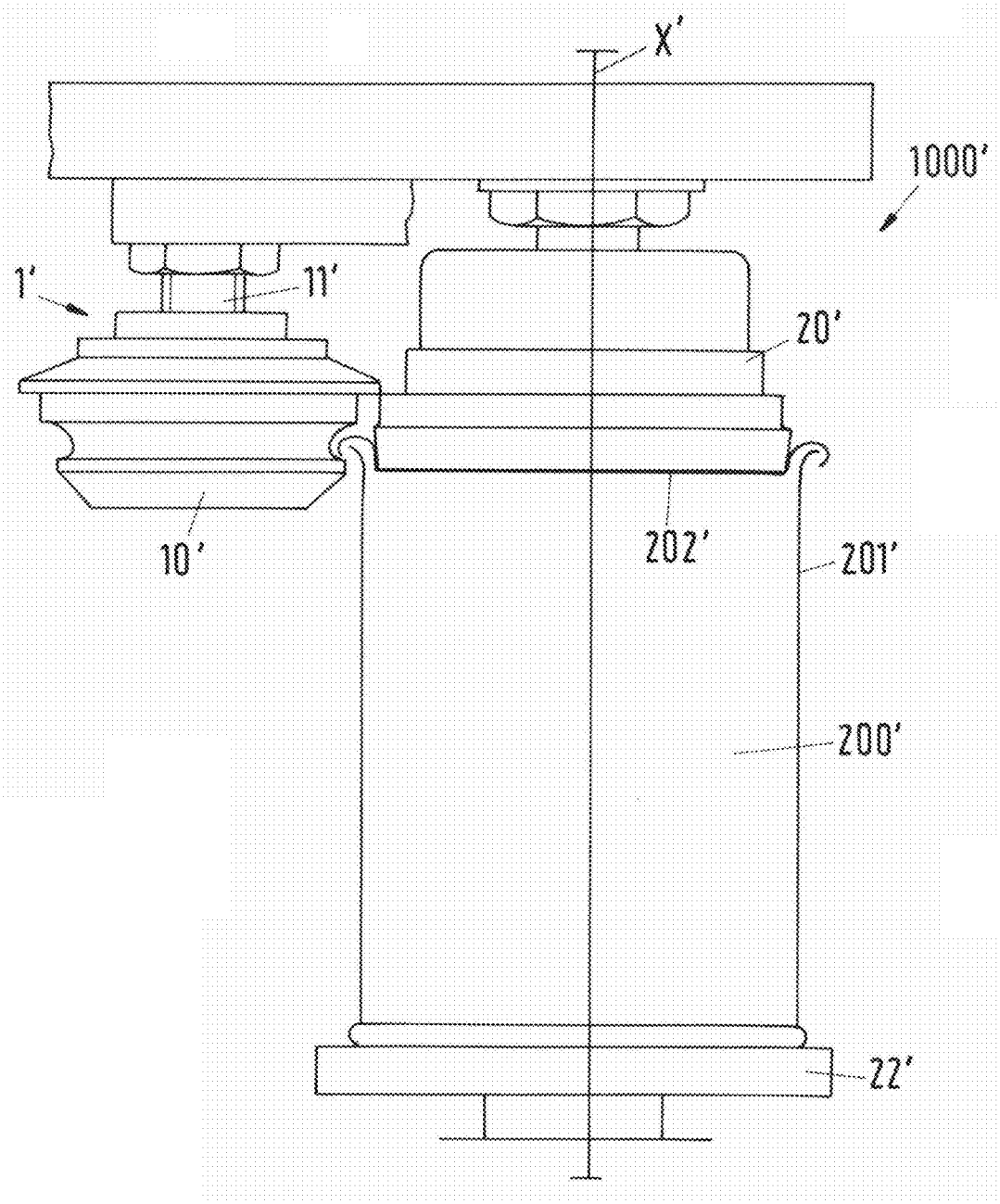
Fig.1 PRIOR ART
FIG. 1 is a schematic representation of the state of the art.

FIG. 1 shows a schematic representation of the state of the art, which has already been described above. As already mentioned above, the reference signs in FIG. 1 have an inverted comma, since they refer to the known state of the art.

Figure 2:
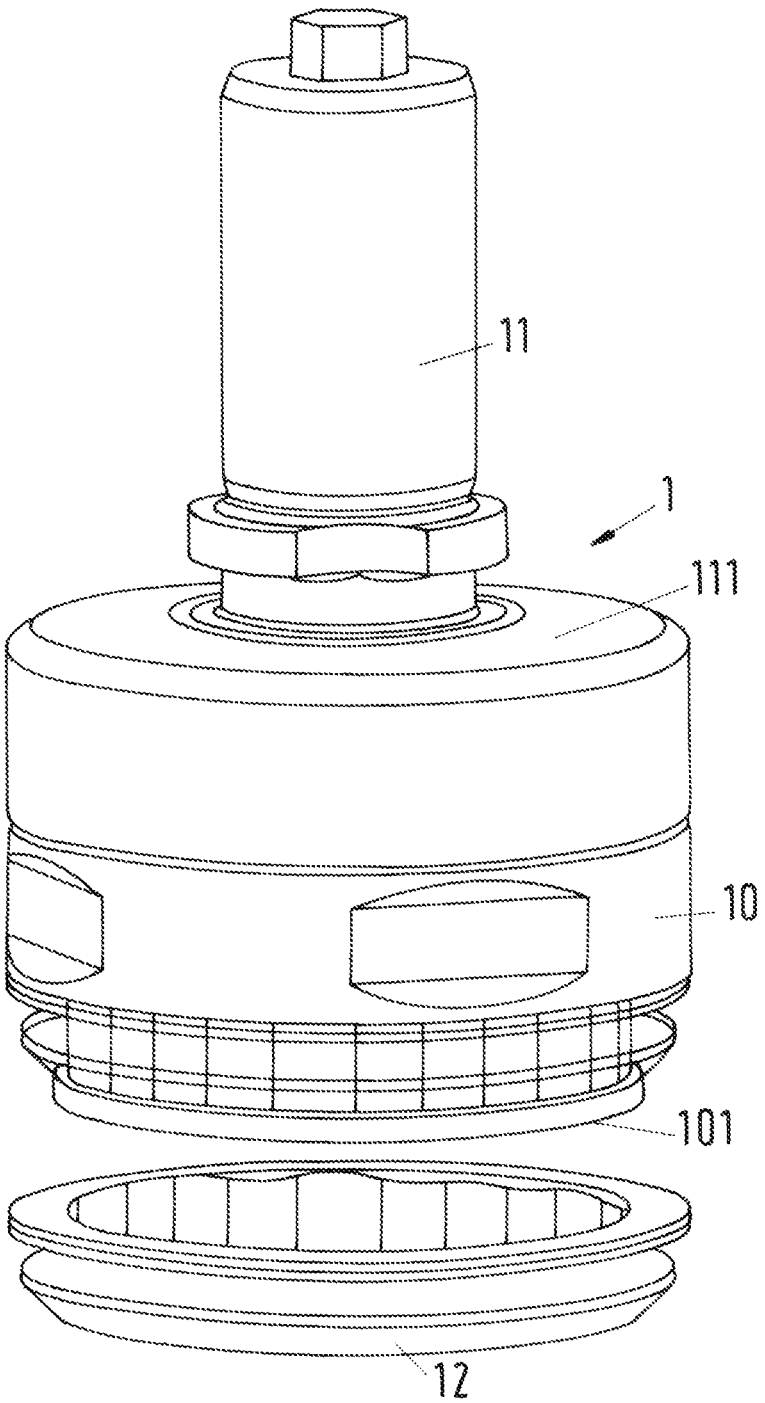
FIG. 2 is a schematic representation of a seaming roll according to an embodiment of the invention.

FIG. 2 shows a schematic representation of a seaming roll according to the invention, which is designated in the following with the reference sign 1.

According to FIG. 2, the seaming roll 1 comprises a cylindrical rotation body 10 rotatable on a bolt 11 for sealing a can (not shown here), wherein the cylindrical rotation body 10 comprises a first round basic side 111 and a second round basic side 101 different from the first basic side 111 as well as a bearing (not shown here). The bolt is arranged in the bearing via the first basic side 111, so that, in the operating state, the rotation body 10 can rotate about the bolt 11 in the circumferential direction of the second basic side 101 when the container is sealed.

The seaming roll 1 has an exchangeable seaming profile 12, which is shown separately, i.e. not fixed to the rotation body. According to an embodiments of the invention, the seaming roll 1 comprises a fastening mechanism, wherein the exchangeable seaming profile 12 is detachably connected to the rotation body 10 via the fastening mechanism. The seaming profile 12 can be placed onto the rotation body 10 from the second basic side 101 and is then connected to the rotation body 10 by the fastening mechanism in a torque-proof and force-locking manner.

In the present embodiment, the seaming profile 12 is designed as seaming profile ring 12. To seam a can lid with a can body of the can, the seaming roll 1 is brought into contact with the can lid flange via the seaming profile 12. Here, the can flange and the can lid flange are pressed together by means of a force acting substantially radially via the seaming roll 1. The pressing is achieved by a continuous rolling of the seaming roll 1 in the circumferential direction along the circumference of a can opening.

Figure 3:
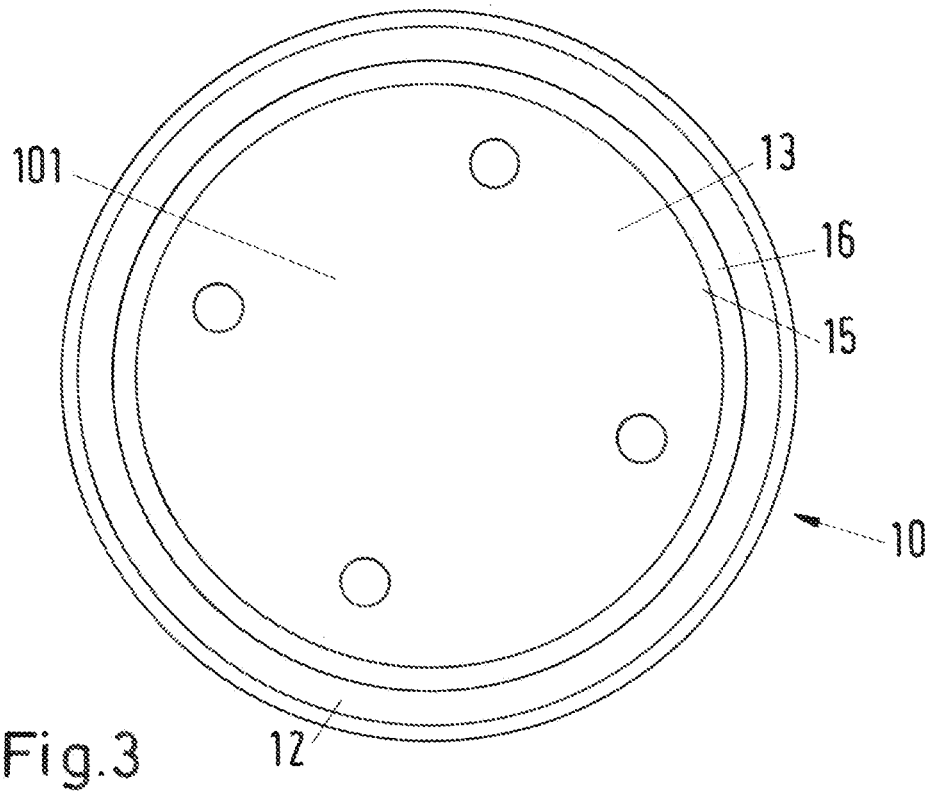
FIG. 3 is a schematic representation of a top view on a second basic side of a seaming roll according to an embodiment of the invention.

FIG. 3 shows a schematic representation of a top view on the second basic side 101 of the seaming roll according to an embodiment of the invention 1.

According to FIG. 3, the seaming roll 1 comprises a cover 13 for sealing the bearing, wherein the cover 13 is arranged detachably on the second basic side 101 of the rotation body 10.

In the embodiment according to FIG. 3, the fastening mechanism (fastener) 15, 16 comprises a pin 15 on the cover 13 of the rotation body 10 and a notch 16 on the seaming profile ring 12.

The cover 13 is designed as a polygon, i.e. as a polygon-shaped plate 13. Corners 15 of the polygon serve as pins 15 for the fastening mechanism 15, 16, which is used for fixing the seaming profile ring 12 with the notch 16. The notches 16 of the seaming profile ring 12 are corresponding to the pins 15 of the cover 13 and are located on an inner circumference of the sealing profile ring 12.

When attaching the seaming profile ring 12, the seaming profile ring 12 is placed with the notch over the cover 13 onto the rotation body 10 in a first cover position. The seaming profile ring 12 has a shape corresponding to the polygonal cover 13, so that the seaming profile ring 12 fits over the cover 13 as exactly as possible. After attaching the seaming profile ring 12 to the rotation body 10, the cover 13 is rotated from a first cover position to a second cover position, wherein the corner (or corners) of the polygon is moved as pin 15 away from the notches 16, so that the seaming profile ring 12 is connected to the rotation body 10 in a torque-proof and force-locking manner. The fastening mechanism 15, 16 is designed as a bayonet lock.

The bayonet lock therefore works in such a way that the cover 13 is designed as a polygon 13 and is attached to the second basic side 101 of the rotation body 10, whereby the bearing is sealed by the cover 13. In principle, by rotating the cover 13, the corners 15 of the cover 13 are rotated from the notches 16 of the seaming profile ring 12 onto the edges (between two notches 16) of the seaming profile ring 12, whereby the seaming profile ring 12 is fixed to the rotation body 10, since a force exerted by the cover 13 acts on the seaming profile ring 12 in the direction of the rotation body 10, by which the seaming profile ring is clamped.

Particularly preferred, the fastening mechanism 15, 16 can additionally comprise a thread arranged on the rotation body 10 and a corresponding counter-thread arranged on the cover 13, so that the cover 13 can be screwed onto the second basic side 101 of the rotation body 10 and wherein the rotation for fixing the seaming profile ring 12 is achieved via the thread/counter-thread.

Figure 4:
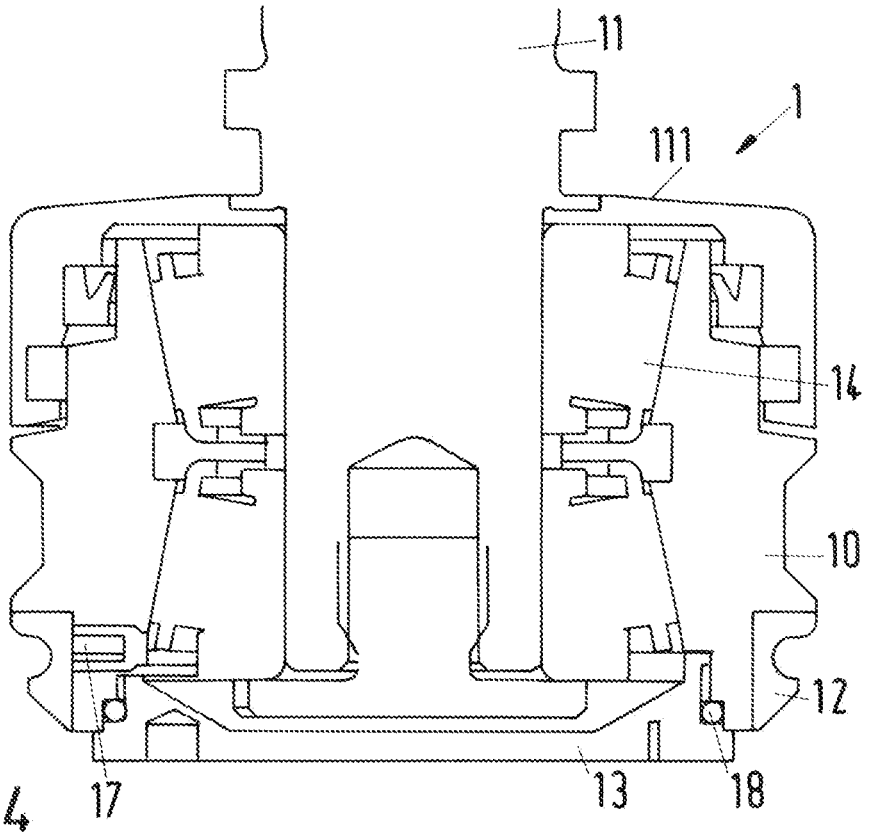
FIG. 4 is a schematic representation of a further embodiment of a seaming roll according to an embodiment of the invention in cross-section.

FIG. 4 shows a schematic representation of a further embodiment of the seaming roll 1 according to the invention in cross-section.

According to FIG. 4, the rotation body 10 comprises the bearing 14 on the inside, whereby the bolt 11 is arranged in the bearing 14 via the first basic side 111.

In addition, a sealing ring 18 is arranged between the cover 13 and the rotation body 10, which closes and seals the bearing 14 to prevent leakage of lubricants.

The sealing ring 18 is preferably an elastic element, which is pressed together when closing the bearing 14 with the cover 13.

Figure 5:
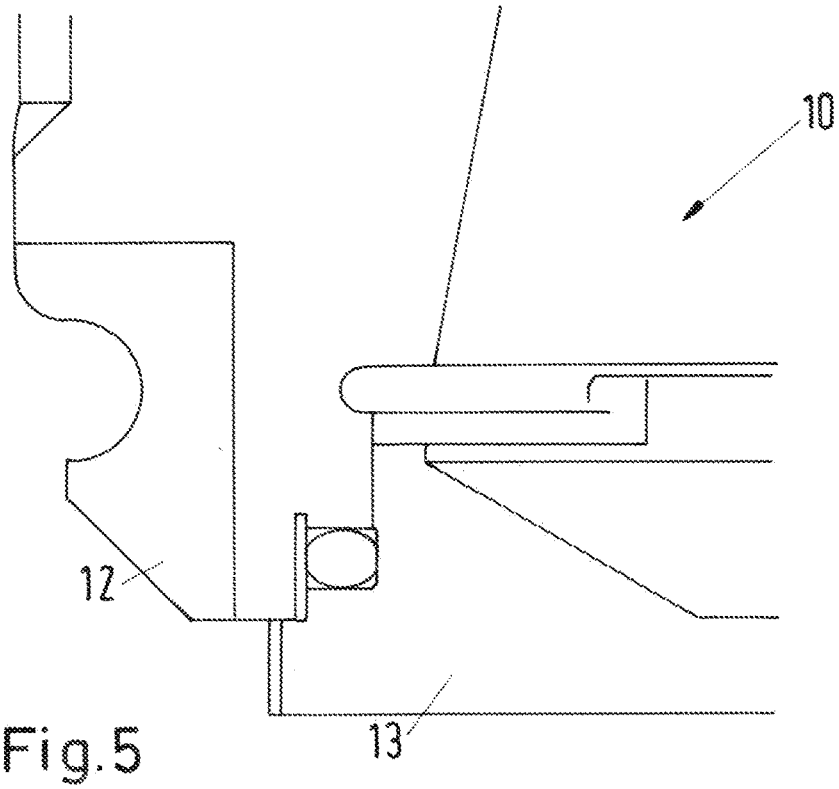
FIG. 5 is a schematic representation of the seaming roll according to an embodiment of the invention of FIG. 4 as a partial section.

FIG. 5 shows a schematic representation of the seaming roll 10 according to the embodiment of the invention of FIG. 4 as a partial section.

Figure 6:
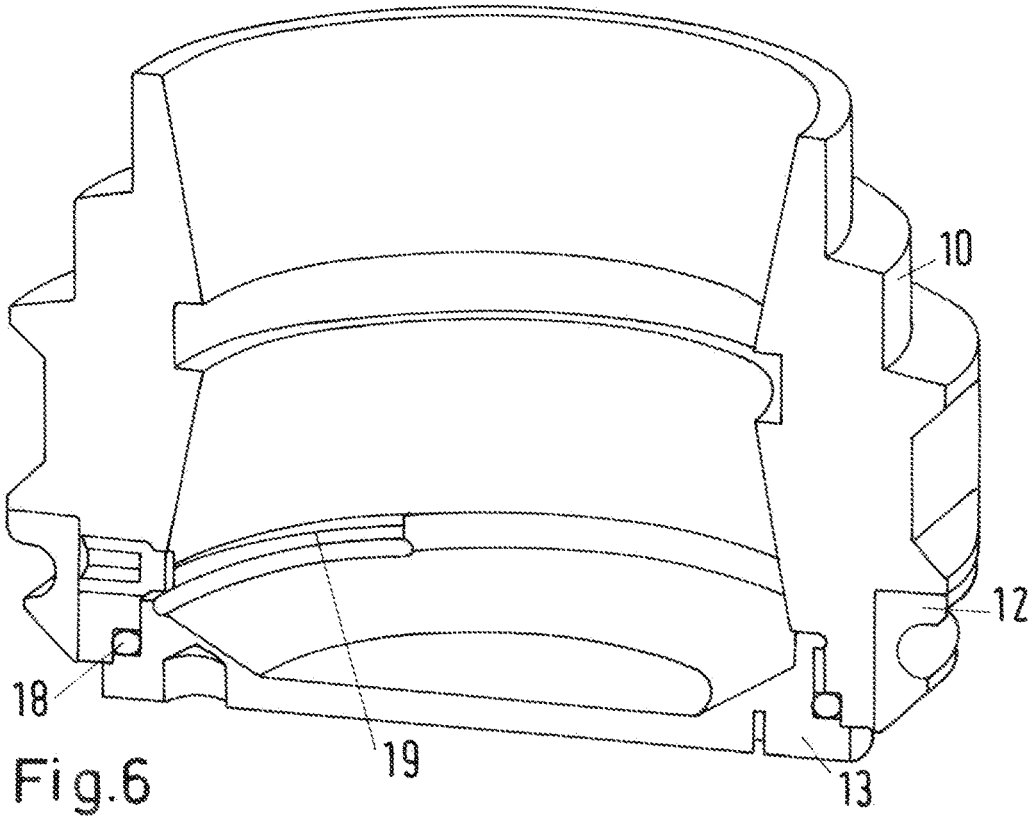
FIG. 6 is a schematic representation of a further seaming roll according to an embodiment of the invention in cross-section.

FIG. 6 shows a schematic representation of a further embodiment of the seaming roll 1 according to the invention in cross-section.

According to FIG. 6, the seaming roll 1 comprises the sealing ring 18 between the cover 13 and the rotation body 10. The seaming roll 1 additionally comprises a safety mechanism 17, wherein the safety mechanism 17 is also arranged between the rotation body 10 and the cover 13, so that the rotation of the cover 13 is delimited, in particular delimited to a rotation from the first cover position to the second cover position.

The safety mechanism 17 is designed as a safety pin 17, which is arranged in a recess 19 of the cover 13. The recess 19 has a recess expansion in the direction of rotation of the cover 13 or in the circumferential direction of the second basic side, so that the rotation of the cover 13 is delimited to the recess expansion. In this way, the cover 13 is prevented from becoming completely detached from the rotation body 10 and thus from the beating (not shown here) in order to prevent leakage of lubricants and thus contamination of the cans. To remove the cover 13 completely, the locking pin 17 consequently has to be removed first. For this purpose, suitable openings for inserting the safety pin 17 can be provided in the rotation body 10 and also in the seaming profile 12.

Figure 7:
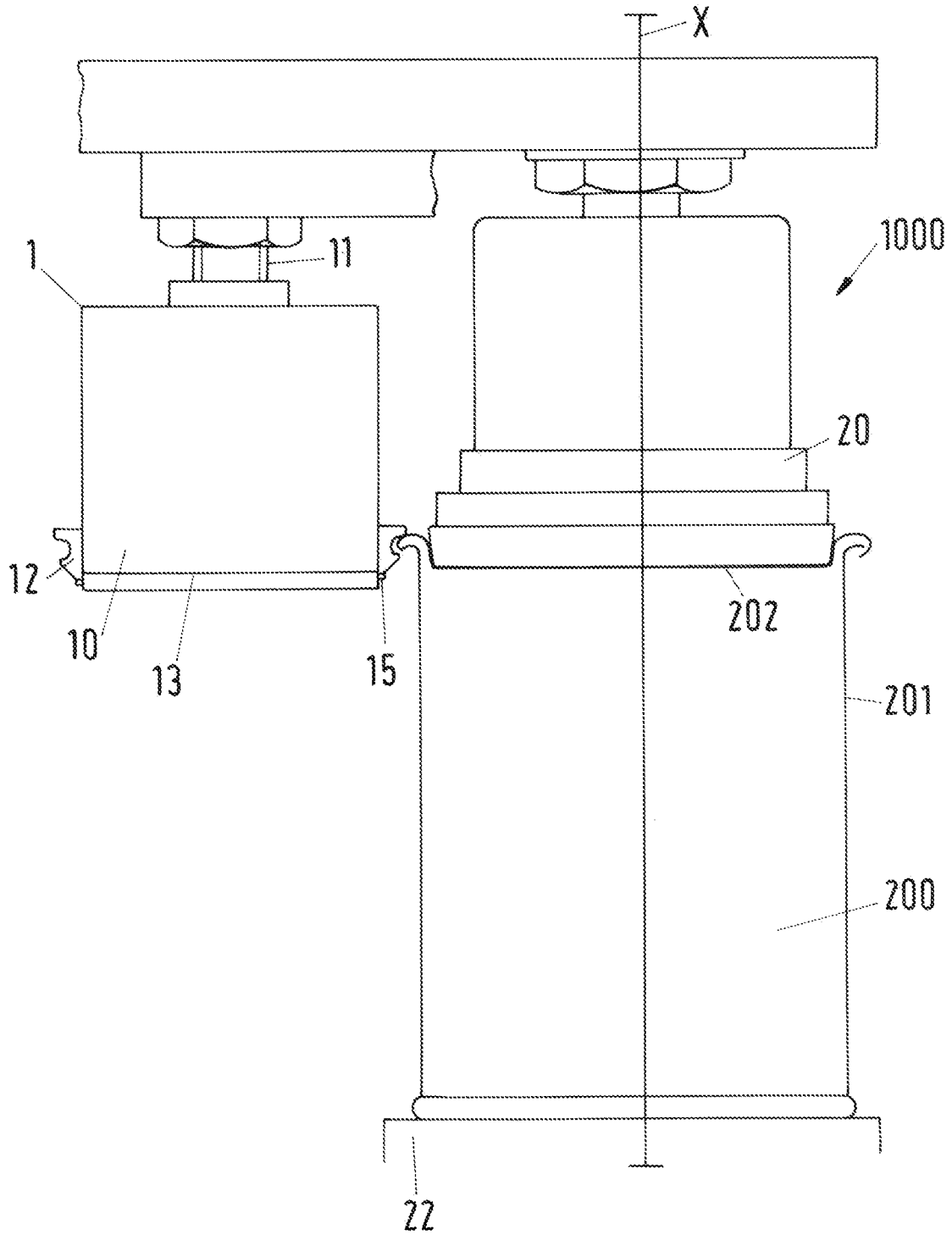
FIG. 7 is a schematic representation of a can sealer according to an embodiment of the invention.

FIG. 7 shows a schematic representation of a can sealer 1000 according to an embodiment of the invention, in which a can 200 to be sealed with a can lid 202 and a can body 201 is arranged.

According to FIG. 7, the can sealer 1000 according to an embodiment of the invention comprises a clamping device 20, 22 comprising a can support 22 and a seaming head 20, and the seaming roll 10 with the exchangeable seaming roll profile 12 rotatably mounted around the bolt 11. The can lid 202 is arranged in a centered way above the opening of the can 200. The can body 201 has a circumferential can flange in the area of the can opening and the can lid 202 has a circumferential can lid flange. In the operating state of the can sealer 1000, the can 200 is rotated around its axis of symmetry X by the clamping device 20, 22.

During the sealing process, the seaming roll 1 is brought into contact with the can lid flange via the seaming roll profile 12. Here, the can flange and the can lid flange are pressed together via the seaming roll 1 by a force acting substantially radially. The pressing is achieved by a continuous rolling of the seaming roll 1 in the circumferential direction along the circumference of the can opening.

The seaming roll 1 according to an embodiment of the invention for sealing the can 200 comprises the bolt 11 and the rotation body 10, which is attached to the can 200 with the seaming profile 12. The rotation body 10 is cylindrical and the cover 13, which is arranged on the second basic side of the rotation body 10, fixes the exchangeable seaming profile 12 to the rotation body 10 with the fastening mechanism 15.

The invention claimed is:

1. A seaming roll for sealing a container comprising:

a rotation body rotatable on a bolt configured to seal the container, the rotation body comprising a first basic side and a second basic side different from the first basic side and a bearing, the bearing arranged on the bolt via the first basic side such that the rotation body is capable of being rotated about the bolt in a circumferential direction of the second basic side when the container is sealed;

an exchangeable seaming profile configured to seam a container lid with a body of the container; and a fastener, the exchangeable seaming profile detachably connected to the rotation body via the fastener, the rotation body comprising a cover configured to seal the bearing and the seaming profile being capable of being placed over the cover onto the rotation body.

2. The seaming roll according to claim 1, wherein the fastener comprises a pin on the rotation body and a notch on the seaming profile, and the seaming profile with the notch is capable of being connected to the pin on the rotation body in a torque-proof and force-locking manner.

3. The seaming roll according to claim 1, wherein and the cover is detachably arranged on the second basic side of the rotation body.

4. The seaming roll according to claim 2, wherein the cover is detachably arranged on the second basic side of the rotation body, the cover comprises the pin and the cover is rotatably arranged on the second basic side of the rotation body such that the seaming profile is capable of being placed with the notch over the cover onto the rotation body in a first cover position and, after rotation of the cover from the first cover position to a second cover position, is connected to the rotation body in a torque-proof and force-locking manner.

5. The seaming roll according to claim 4, wherein the cover is a polygon, and one corner of the polygon is the pin of the fastener.

6. The seaming roll according to claim 3, wherein the fastener comprises a thread arranged on the rotation body and a counter thread is arranged on the cover, the seaming profile fastened to the rotation body over the cover.

7. The seaming roll according to claim 3, further comprising a safety mechanism arranged between the rotation body and the cover so that the rotation of the cover is delimited.

8. The seaming roll according to claim 1, wherein the fastener comprises a thread arranged on the rotation body and a counter thread arranged on the seaming profile.

9. The seaming roll according to claim 7, wherein the safety mechanism is a safety pin.

10. The seaming roll according to claim 1, wherein the first basic side or the second basic side is round.

11. The seaming roll according to claim 1, wherein the rotation body is a cylindrical rotation body and the seaming profile is a seaming profile ring.

12. The seaming roll according to claim 1, wherein the bearing is a ball bearing or a cylindrical roller bearing.

13. The seaming roll according to claim 1, wherein a seal is arranged between the cover and the rotation body to prevent leakage of lubricants from the bearing.

14. The seaming roll according to claim 5, wherein the cover is a symmetrical polygon.

15. The seaming roll according to claim 5, wherein the cover is an asymmetrical polygon.

16. A sealer comprising:

the seaming roll according to claim 1.

17. The sealer according to claim 16, further comprising a clamping device.

18. The sealer according to claim 16, wherein the seaming roll is one of at least two seaming rolls.

* * * * *